US006205769B1

(12) United States Patent
Brandenburg et al.

(10) Patent No.: US 6,205,769 B1
(45) **Date of Patent: *Mar. 27, 2001**

(54) COMPACT COUPLING FOR MICROWAVE-ELECTRO-THERMAL THRUSTER

(76) Inventors: John E. Brandenburg, 7824 Sutter La., #204, Annandale, VA (US) 22003; Michael Micci, 43014 30th St. W., Lancaster, CA (US) 93536

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/484,513

(22) Filed: Jun. 7, 1995

(51) Int. Cl.[7] ..... E03H 1/00

(52) U.S. Cl. ..... 60/203.1

(58) Field of Search ..... 60/200.1, 203.1, 60/202

(56) References Cited

U.S. PATENT DOCUMENTS

| | | | | |
|---|---|---|---|---|
| 3,083,528 | * | 4/1963 | Brown | 60/203.1 |
| 3,114,517 | * | 12/1963 | Brown | 60/203.1 |
| 3,206,925 | * | 9/1965 | Schiff | 60/203.1 |
| 3,891,160 | * | 6/1975 | Minovitch | 244/1 SS |
| 4,957,061 | * | 9/1990 | Ando et al. | 118/719 |

* cited by examiner

*Primary Examiner*—Louis J. Casaregola
(74) *Attorney, Agent, or Firm*—Venable; James E. Burdett

(57) ABSTRACT

Microwave-Electro-Thermal thrusters produce a high temperature rocket exhaust by sending microwaves into a resonant cavity where an excited mode then creates an electrodeless discharge that heats gaseous fuel. Heretofore, the microwave power coupling between the microwave generator and the resonant cavity and plasma has consisted of rigid waveguide with impedance matching equipment. This waveguide and impedance matching hardware greatly adds to the weight and size of the system making it impractical for spaceflight. The foregoing problems are overcome by greatly reducing or eliminating the waveguide and impedance matching equipment.

2 Claims, 7 Drawing Sheets

COMPACT COUPLING FOR MICROWAVE-ELECTRO-THERMAL THRUSTER

FIELD AND BACKGROUND OF THE INVENTION

1. Field of the Invention

The invention relates to control of spacecraft and more particularly to control of propulsion or attitude spacecraft using microwave-electro-thermal thrusters.

2. Background Information

The invention described and claimed herein comprises a novel compact coupling for microwave-electro-thermal thrusters.

The MET(Microwave-Electro-Thermal) thruster produces rocket thrust for the control of spacecraft via electricity for small satellites. The MET produces a high temperature rocket exhaust by sending microwaves into a resonant cavity where an excited mode then creates an electrodeless discharge that heats gaseous fuel.

Heretofore, the microwave power coupling between the microwave generator and the resonant cavity and plasma has consisted of rigid waveguide with impedance matching equipment. This waveguide and impedance matching hardware greatly adds to the weight and size of the system making it impractical for spaceflight. In particular, the size of the system and rigid waveguide connections make it difficult to place the MET thrust chamber on a steerable gimbaled platform on the spacecraft.

SUMMARY OF THE INVENTION

The foregoing problems are overcome, and other advantages are provided by greatly reducing or eliminating the waveguide and impedance matching equipment.

It is an object of the invention to provide a reduced weight coupling for MET thrusters.

A principal feature of the invention is the reduced size or elimination of waveguide and impedance matching equipment.

Among the advantages of the invention are the resultant lower weight and therefore cheaper launch cost of vehicles employing the invention.

These and other objects, features and advantages which will be apparent from the discussion which follows are achieved, in accordance with the invention, by providing a novel compact coupling for microwave-electro-thermal thrusters.

The various features of novelty which characterize the invention are pointed out with particularity in the claims annexed to and forming a part of this disclosure. For a better understanding of the invention, its advantages and objects, reference is made to the accompanying drawings and descriptive matter in which a preferred embodiment of the invention is illustrated.

BRIEF DESCRIPTION OF THE DRAWINGS

The foregoing and still other objects of this invention will become apparent, along with various advantages and features of novelty residing in the present embodiments, from study of the following drawings, in which.

DESCRIPTION OF THE PREFERRED EMBODIMENT

Figure 1:
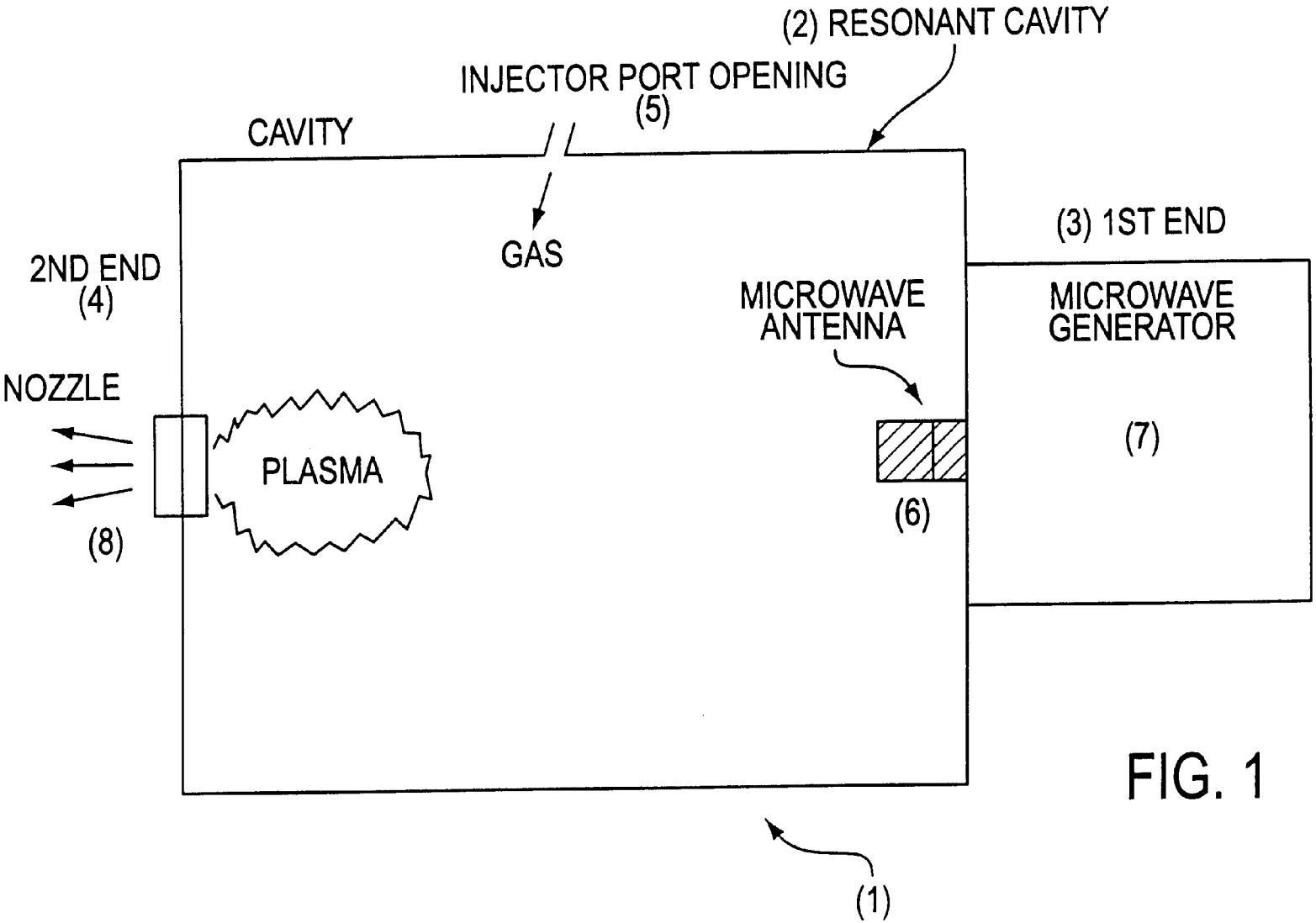
FIG. 1 is a schematic diagram of the invention.

Referring to the drawings, the invention is a novel compact coupling for microwave-electro-thermal thrusters.

Referring to FIG. 1, a MET thruster (1) comprises an approximately resonant cavity (2) having first (3) and second (4) ends, at least one injector port opening (5) in the cavity (2) for the injection of a gas, a microwave antenna (6) carried by the first end (3) of the cavity (2). The microwave antenna (6) is coupled to a microwave generator (7) which generates microwaves which are emitted into the cavity (2) where they interact with and heat the gas so as to create a heated gas plasma. A nozzle (8) carried by the second end (4) of the cavity (2) allows for the exit of the heated gas plasma. As the plasma exits the cavity (2), it creates thrust which may be used to control the spacecraft.

Preferably, the MET thruster may be operated with a magnetron microwave generator inserted directly into the resonant cavity (2) with no intermediate waveguide, but only a tuned 1/4 free-space wavelength antenna being used. This innovation results in a much more compact and lightweight design for the MET than has been previously been demonstrated for the MET and makes the MET an attractive technology for space flight.

A microwave generator, such as a magnetron, klystron, or traveling wave tube, is joined directly with a resonant cavity in a coaxial configuration with the output stub of the microwave generator inserted into the approximately resonant cavity to excite a transverse magnetic, azimuthally symmetric, bisymmetrically along the axis (TM010 mode) for the purposes of heating a plasma which acts as a thermal rocket exhaust. The resonance condition of the cavity being only approximate due to the loading of the cavity by the discharge. The sole impedance matching element between the microwave generator and the cavity is an antenna attached to the output stub of the generator tuned to be 1/4 of a free space wavelength in effective length and this antenna projects into the resonant cavity. This allows a lighter MET system to be used in space without using bulky waveguides and other impedance matching devices being interposed between the generator and the cavity.

Figure 2:
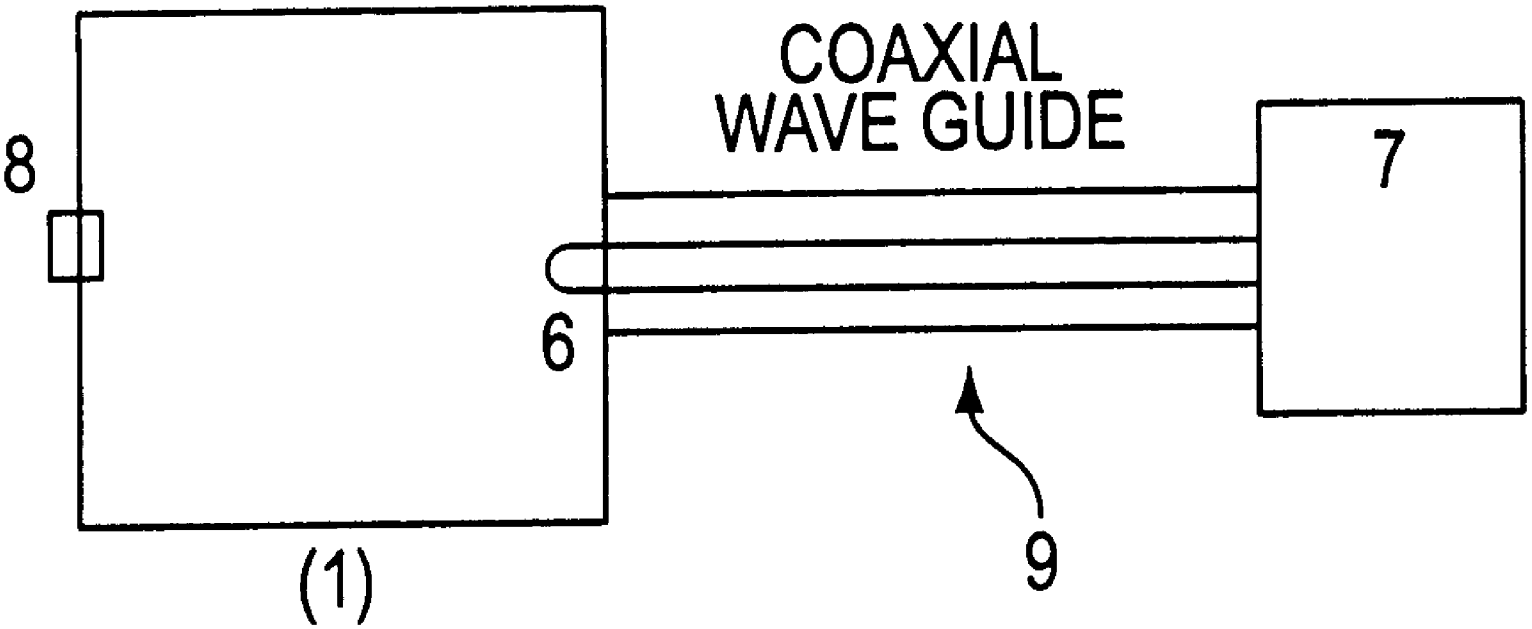
FIG. 2 illustrates an embodiment of the invention using coaxial waveguide.
Figure 3:
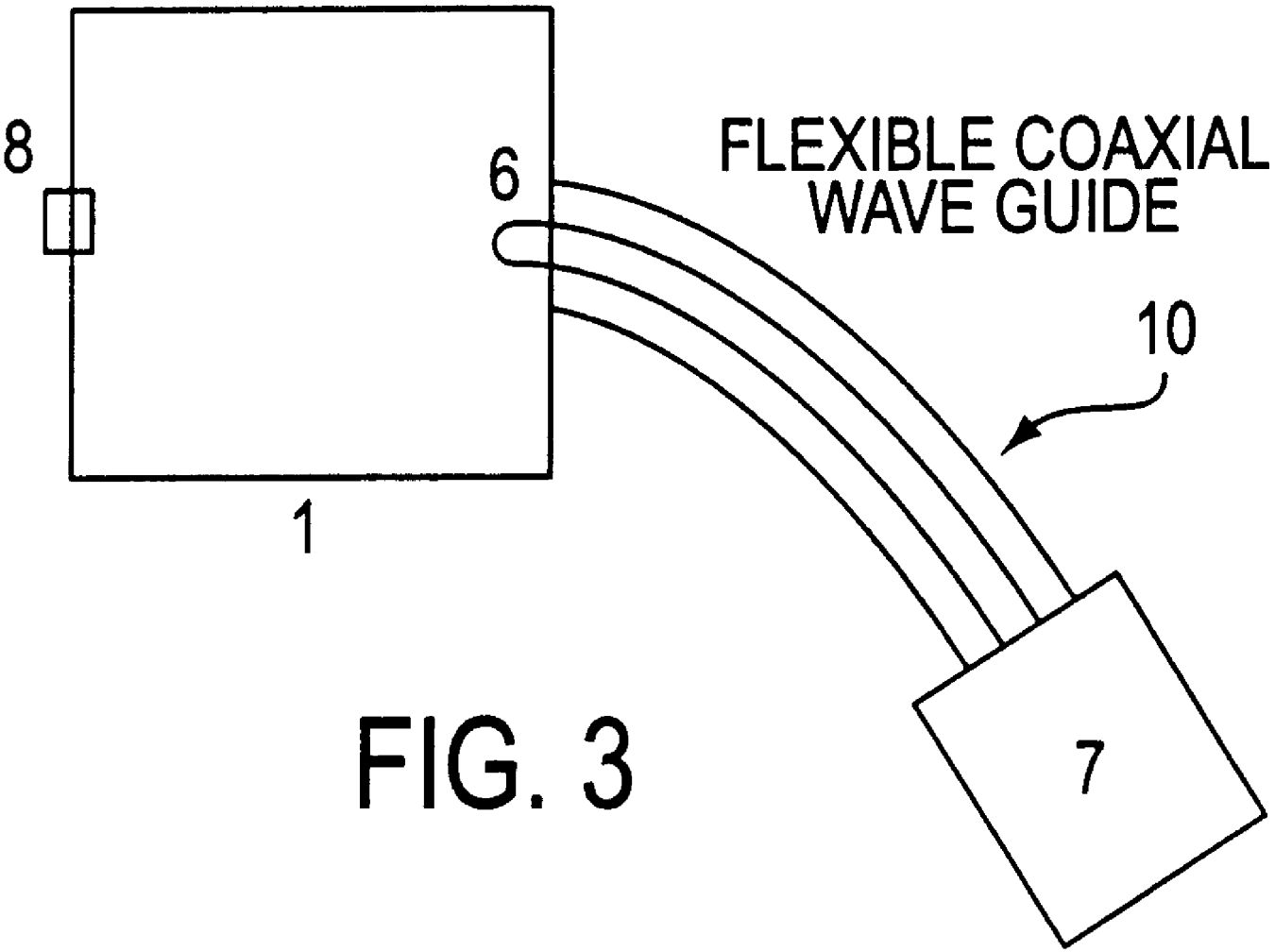
FIG. 3 illustrates an embodiment of the invention using flexible coaxial waveguide.
Figure 4:
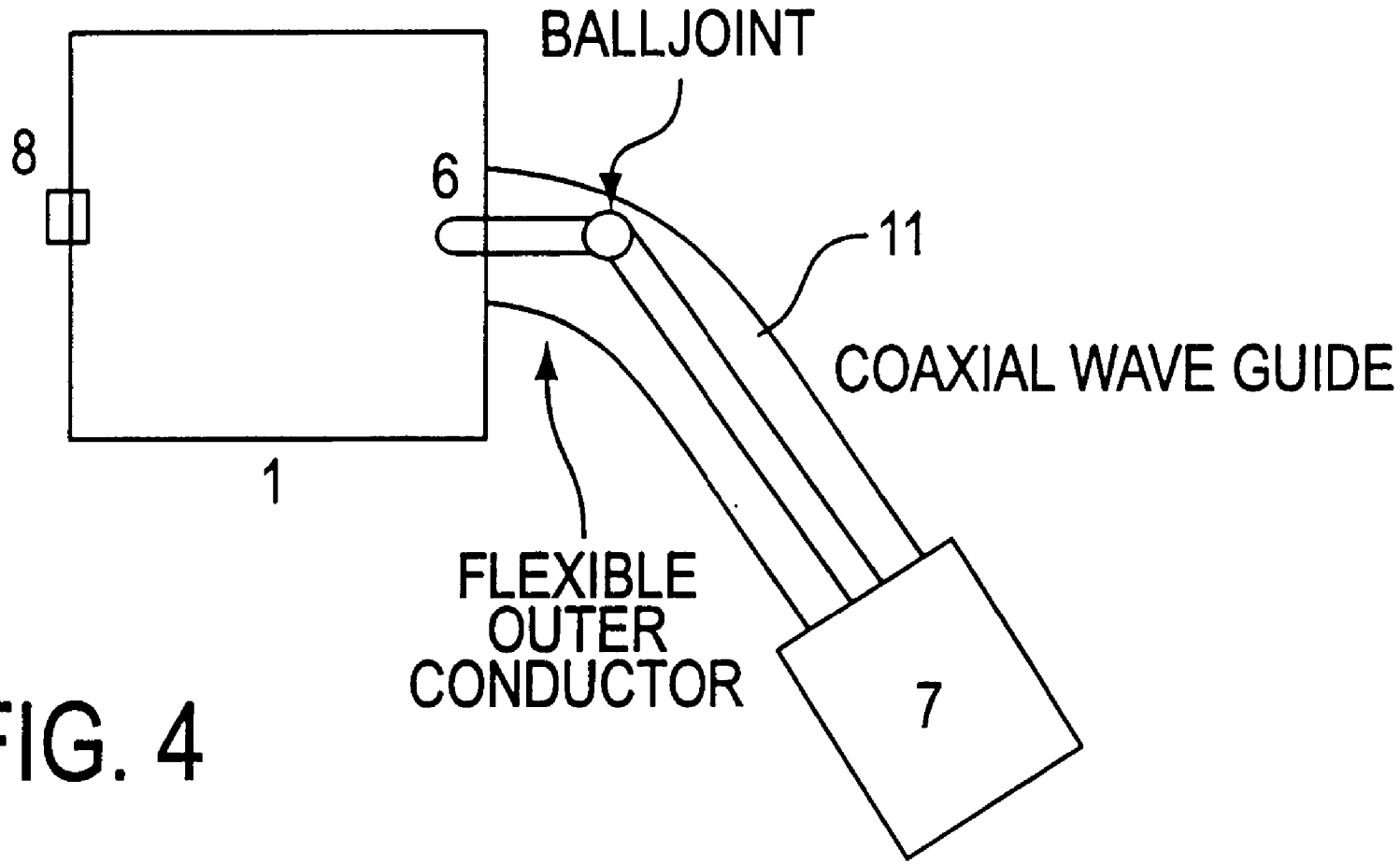
FIG. 4 illustrates an embodiment of the invention using waveguide with flexible outer conductor and balljoint inner conductor.
Figure 5:
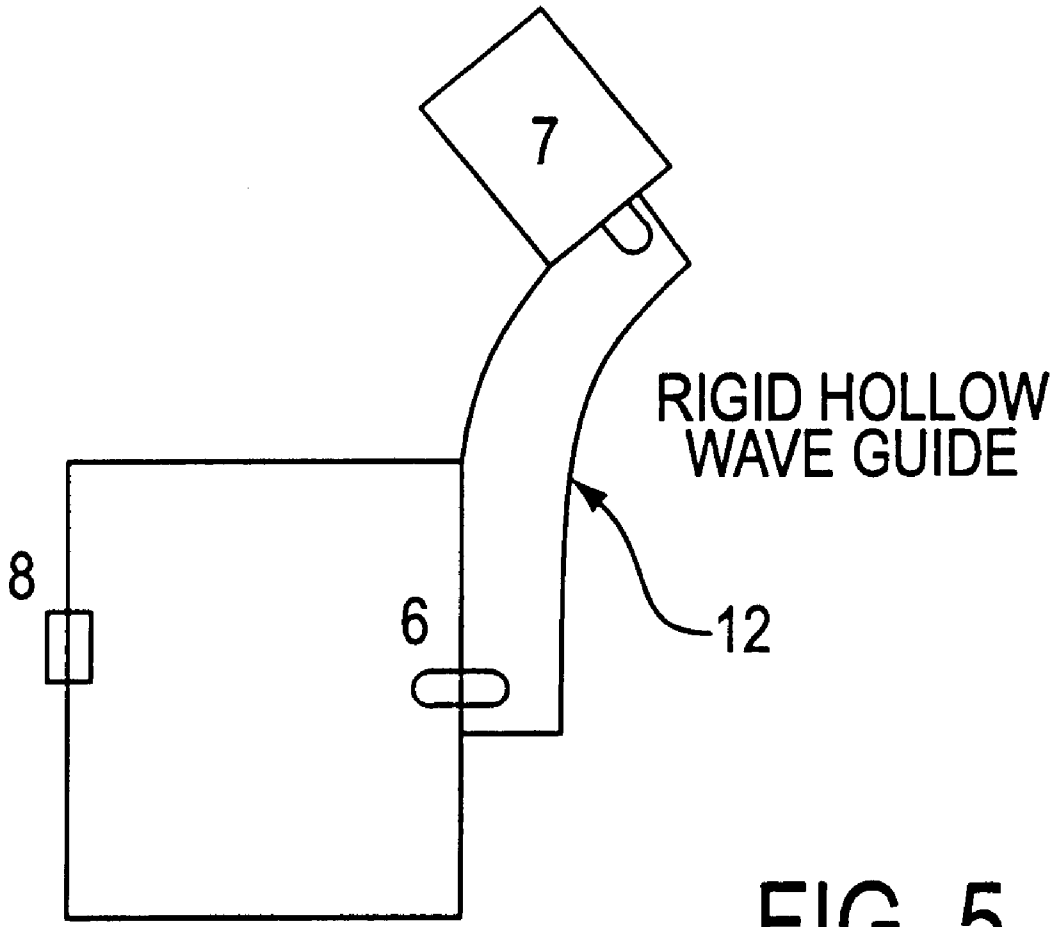
FIG. 5 illustrates an embodiment of the invention using rigid hollow waveguide.
Figure 6:
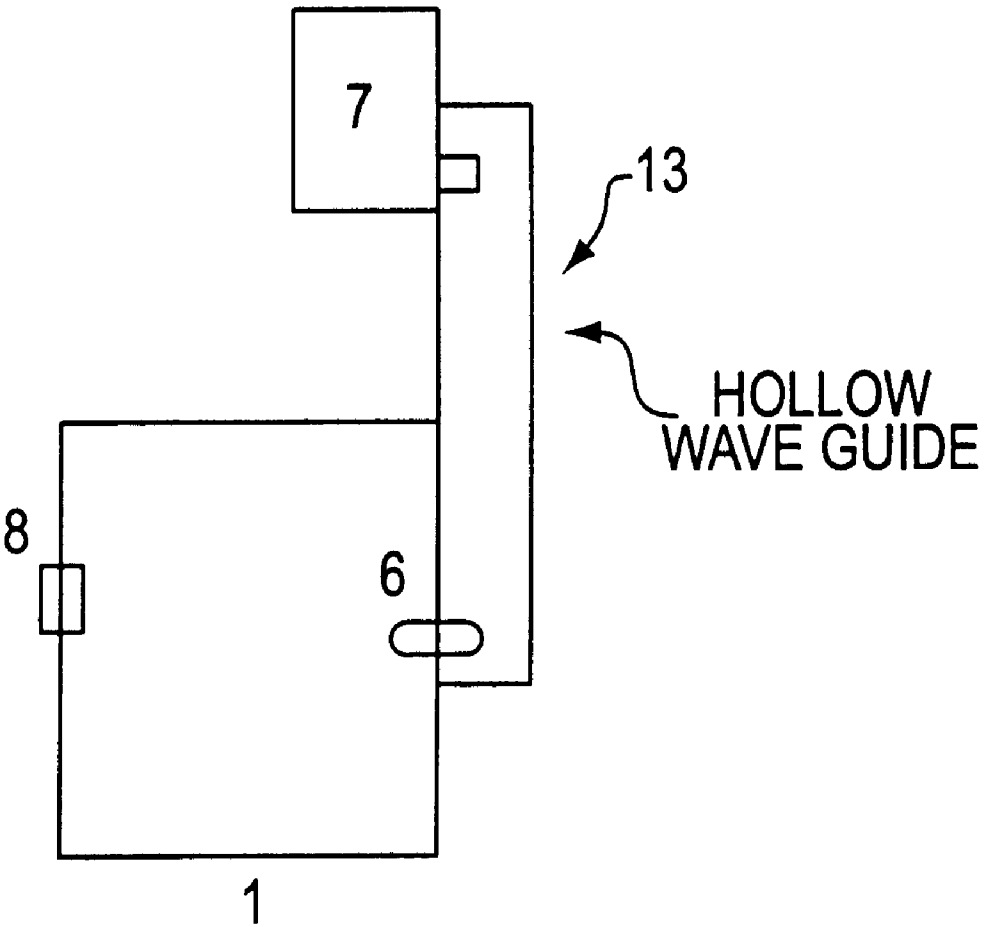
FIG. 6 illustrates an embodiment of the invention using hollow waveguide.
Figure 7:
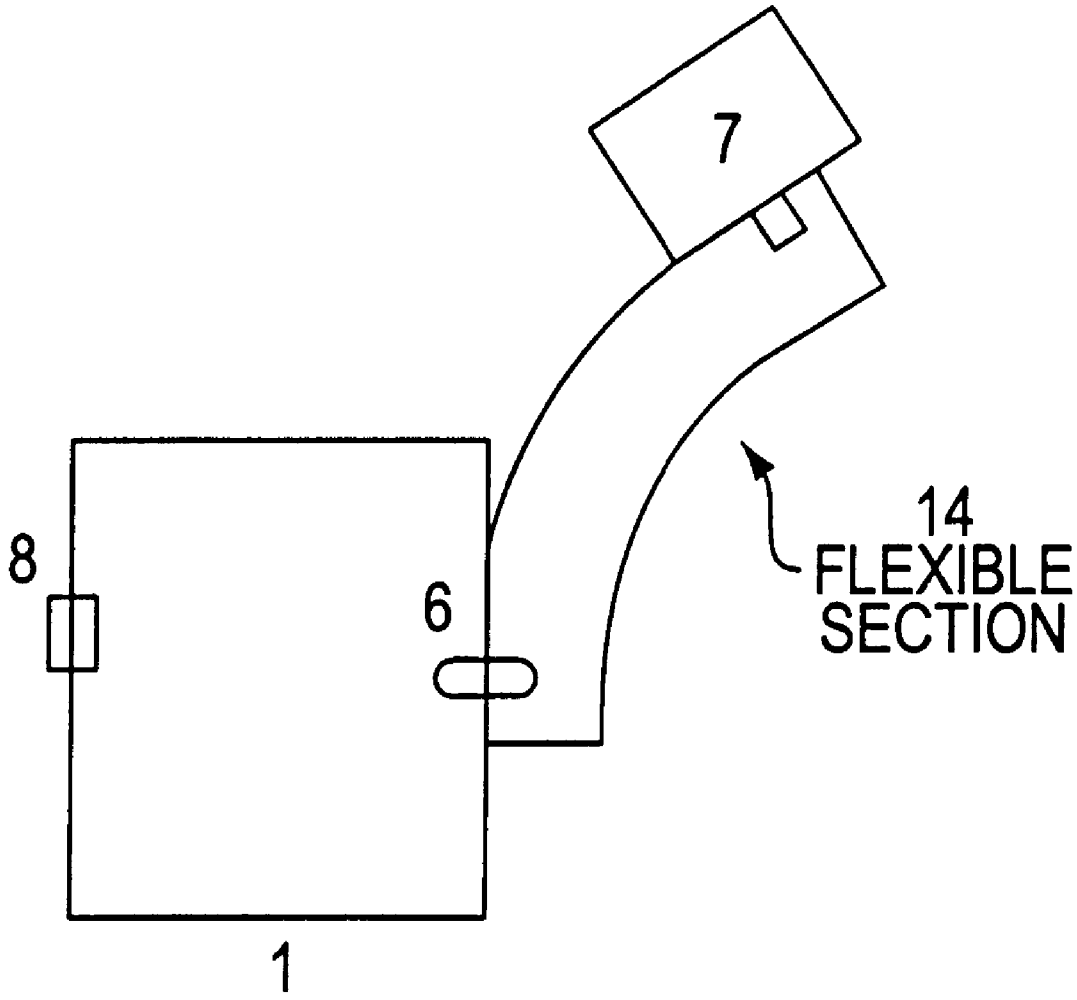
FIG. 7 illustrates an embodiment of the invention using a flexible section.

Connectors less than two (2) wavelengths long would provide the desired advantages and could consist of rigid coaxial waveguide (9, FIG. 2), waveguide with flexible inner and outer conductors (10, FIG. 3), waveguide with a flexible outer conductor and a universal or balljointed inner conductor (11, FIG. 4), rigid non-axial generator mounted on a bent hollow waveguide (12, FIG. 5), rigid hollow waveguide (13, FIG. 6), or waveguide with a flexible section (14, FIG. 7). There is no requirement that the waveguide be coaxial with the cavity, and non-coaxial configurations may provide advantages from the viewpoint of heat management.

EXPERIMENTAL RESULTS

A prototype compact coupling experiment was conducted in which a Panasonic 2M210 Magnetron output (2.45 GHz)

was attached to an approximately TM010 resonant mode cavity on its axis via a coaxial waveguide of 7/4 wavelength (21 cm) and by directly inserting its 1/4 (3 cm) wavelength antenna into the cavity on axis. The MET performed in the direct insertion mode just as it had at the end of the waveguide and the discharge was unchanged. Thermal safety switches in place on the magnetron, designed to shut off the power in case of magnetron overheating, which would indicate high reflected power and thus poor impedance matching, did not trigger during operation, indicating the magnetron ran within normal temperature range and thus was adequately matched.

Similarly a magnetron (such as a Toshiba 2M172) was used to drive the cavity by inserting its output antenna into a hollow waveguide coupled to the cavity via an output antenna located at the end of the waveguide. This allowed the magnetron to be mounted adjacent to the cavity. In this experiment the magnetron was mounted side-by side with the cavity with only 21 cm separating their centers. It is possible that microwaves could be coupled between a cavity and a magnetron using a coaxial waveguide with a flexible portion, thereby allowing the cavity to be tilted relative to the fixed waveguide, as is common practice in the microwave field.

Thus, there has been described a novel compact coupling for microwave-electro-thermal thrusters and a manner of making and using the invention.

While a specific embodiment of the invention has been shown and described in detail to illustrate the application of the principles of the invention, it will be understood that the invention may be embodied otherwise without departing from such principles and that various modifications, alternate constructions, and equivalents will occur to those skilled in the art given the benefit of this disclosure. Thus, the invention is not limited to the specific embodiment described herein, but is defined by the appended claims.

We claim:

1. A propulsion device comprising:

a microwave generator;

a resonant cavity having first and second ends;

an injector port opening in said cavity for injection of a gas;

means for coupling said microwave generator to said cavity, said coupling means including a microwave antenna of a predetermined wavelength, said microwave antenna being inserted within said cavity at said first end, and coupled to said microwave generator for the generation of microwaves for interaction with said gas so as to heat said gas and create a heated gas plasma; and a nozzle connected to said second end of said cavity for exhausting said heated gas plasma;

wherein said coupling means and said microwave antenna together comprise a length of less than about 2 wavelengths of said microwave antenna.

2. A device as in claim 1 wherein said microwave antenna comprises a tuned ¼ free-space wavelength antenna.

* * * * *